US008733753B2

(12) United States Patent
Soga et al.

(10) Patent No.: US 8,733,753 B2
(45) Date of Patent: May 27, 2014

(54) SHEET PROCESSING DEVICE

(75) Inventors: Naofumi Soga, Shizuoka-ken (JP); Kikuo Mizutani, Shizuoka-ken (JP); Tomomi Iijima, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 259 days.

(21) Appl. No.: 13/190,315

(22) Filed: Jul. 25, 2011

(65) Prior Publication Data

US 2012/0025441 A1 Feb. 2, 2012

Related U.S. Application Data

(60) Provisional application No. 61/368,609, filed on Jul. 28, 2010, provisional application No. 61/368,611, filed on Jul. 28, 2010, provisional application No. 61/372,437, filed on Aug. 10, 2010.

(30) Foreign Application Priority Data

Jul. 6, 2011 (JP) ..... P2011-150011

(51) Int. Cl.
*B65H 37/04* (2006.01)

(52) U.S. Cl.
USPC ..... 270/58.09; 270/58.08; 270/58.12; 399/410

(58) Field of Classification Search
USPC ..... 270/58.08, 58.09, 58.11, 58.12, 58.13; 399/410
See application file for complete search history.

(56) References Cited

U.S. PATENT DOCUMENTS

| | | | | |
|---|---|---|---|---|
| 5,762,328 | A * | 6/1998 | Yamada et al. | 270/58.08 |
| 6,698,744 | B2 * | 3/2004 | Yamada et al. | 270/58.12 |
| 7,946,569 | B2 * | 5/2011 | Suzuki et al. | 270/58.12 |
| 8,226,079 | B2 * | 7/2012 | Ozawa | 270/58.09 |
| 2008/0067730 | A1 * | 3/2008 | Suzuki et al. | 270/37 |

FOREIGN PATENT DOCUMENTS

| | | | |
|---|---|---|---|
| JP | 3732812 | | 1/2006 |
| JP | 3746472 | | 2/2006 |
| JP | 2007140415 | A * | 6/2007 |

* cited by examiner

*Primary Examiner* — Patrick Mackey

(74) *Attorney, Agent, or Firm* — Patterson & Sheridan, L.L.P.

(57) ABSTRACT

According to one embodiment, a sheet processing device includes a jogger fence configured to carry out a crosswise direction alignment to a stack of image formed sheets ejected from an image forming apparatus, a rear end fence acting as a lengthwise reference edge, a stapling device configured to staple the aligned sheet stack, a discharge belt configured to move the stapled sheet stack to a sheet ejection tray, and a controller to control movement of the jogger fence during the sheet stack being moved by the discharge belt so as to move the jogger fence more than once between a position where the jogger fence does not contact the edge of the sheet stack and a position where the jogger fence pressing contact the edge of the sheet stack.

12 Claims, 16 Drawing Sheets

SHEET PROCESSING DEVICE

CROSS-REFERENCE TO RELATED APPLICATION

This application is based upon and claims the benefit of priority from the prior U.S. patent application Nos. 61/368,609, filed on Jul. 28, 2010, 61/368,611, filed on Jul. 28, 2010, and 61/372,437, filed on Aug. 10, 2010, the entire contents of which are incorporated herein by reference.

This application is also based upon and claims the benefit of priority from Japanese Patent Application No. 2011-150011, filed on Jul. 6, 2011, the entire contents of which are incorporated herein by reference.

FIELD

Exemplary embodiments described herein relate to a sheet processing device provided with processing capabilities, such as sorting, stapling and reinforcing functions.

BACKGROUND

In the sheet processing device provided with processing capabilities, such as sorting, a stapling, a reinforcing of the folded sheet, the sheet processing device which discharges a sheet adjusting sheet and maintaining matching states when processing a sheet is known. However, when conveying a sheet, in the usual matching plate, there is a fault from which the matching states of a sheet shift easily.

DETAILED DESCRIPTION

In general, according to one embodiment, there is provided with a sheet processing device including: a jogger fence configured to carry out a crosswise direction alignment to a stack of image formed sheets ejected from an image forming apparatus; a rear end fence acting as a lengthwise reference edge; a stapling device configured to staple the aligned sheet stack; a discharge belt configured to move the stapled sheet stack to a sheet ejection tray; and a controller to control movement of the jogger fence during the sheet stack being moved by the discharge belt so as to move the jogger fence more than once between a position where the jogger fence does not contact the edge of the sheet stack and a position where the jogger fence pressing contact the edge of the sheet stack.

With reference to an accompanying drawing, the embodiment of a sheet processing device is described below.

(A first embodiment) A first embodiment of the present invention is a sheet processing device wherein a jogger fence performs movements to a retreating position and a sheet pressed position at the time of sheet discharge.

Figure 1:
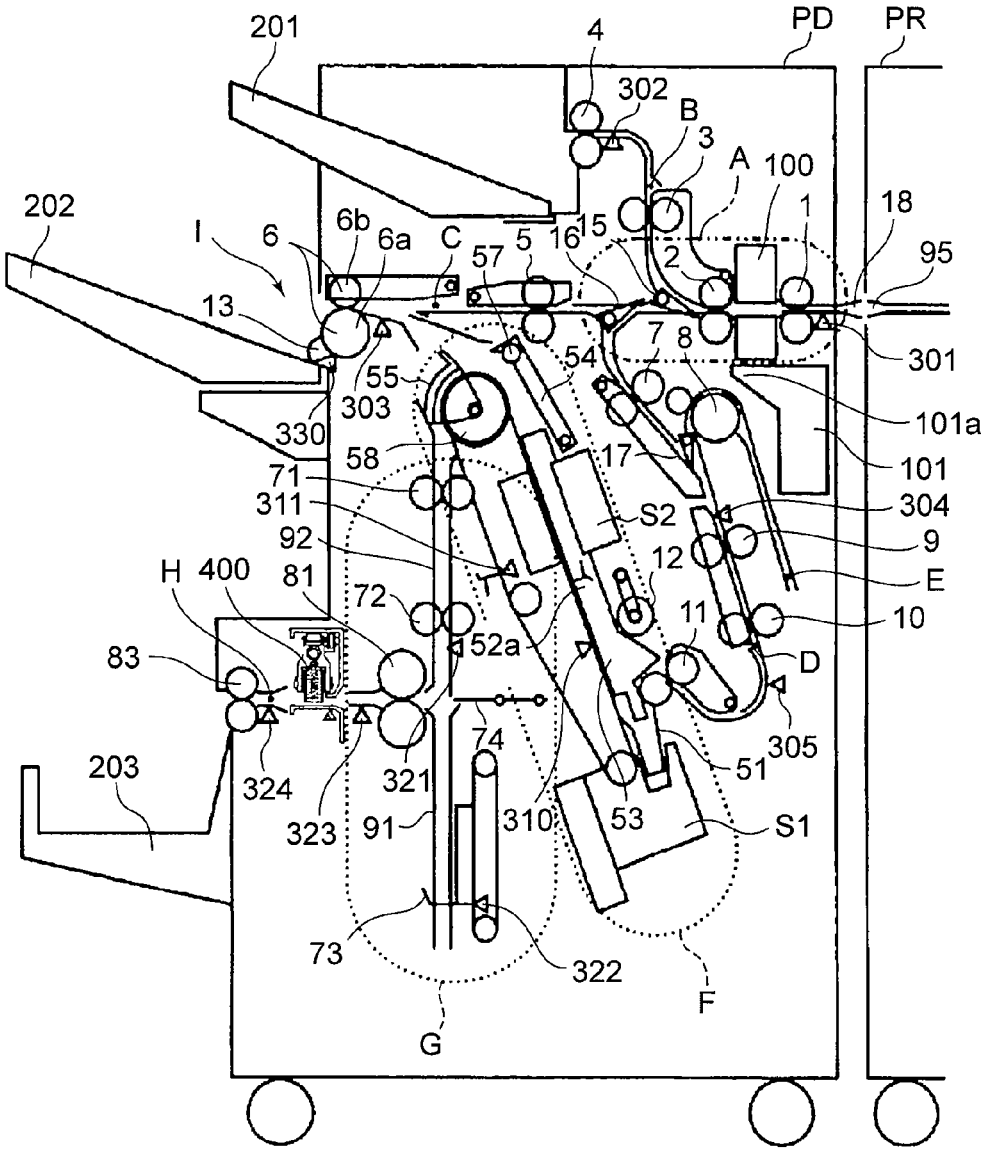
FIG. 1 is a view showing a sheet processing device according to a first embodiment.

FIG. 1 shows an image forming system which is comprised of a sheet processing device PD as a sheet processing device according to the first embodiment and an image forming device PR. FIG. 1 shows the whole of the sheet processing device PD and a part of the image forming device PR.

As shown in FIG. 1, sheet processing device PD is attached to the image forming device PR. A recording medium discharged from a delivery port of the image forming device PR is led to a feed port 18 of the sheet processing device PD. The recording medium, e.g., a sheet herein, is steered to a carrying path B in which a sheet passes along the carrying path A having a sheet post-processing means to an upper tray 201, a carrying path C wherein a sheet passes to a shift tray 202, a carrying path D wherein a sheet passes to a stapling tray F for carrying out an aligning and stapling etc, respectively.

Sheets sequentially brought to the staple tray F via the paths A and D are positioned one by one, stapled or otherwise processed, and then steered by a guide plate 54 and a movable guide 55 to either one of the path C and another processing tray G. The processing tray G folds or otherwise processes the sheets and, in this sense, will sometimes be referred to as a fold tray hereinafter. The sheets folded by the fold tray G are further strongly folded by a reinforce roller 400 and then guided to a lower tray 203 via a path H. The path D includes a path selector 17 constantly biased to a position shown in FIG. 1 by a light-load spring not shown. An arrangement is made such that after the trailing edge of a sheet has moved away from the path selector 17, among rollers 9 and 10 and a staple outlet roller 11, at least the roller 9 and a re-feed roller 8 are rotated in the reverse direction to convey the trailing edge of the sheet to a pre-stacking portion E and cause the sheet to stay there. In this case, the sheet can be conveyed together with the next sheet superposed thereon. Such an operation may be repeated to convey two or more sheets together.

On the carrying path A merging into the carrying paths B, C and D, there are sequentially arranged an inlet sensor 301 responsive to a sheet coming into the finisher PD, an inlet roller pair 1, the punch unit 100, a waste hopper 101, roller pair 2, and path selectors 15 and 16. The path selectors 15 and 16 are held with springs at the state as shown in FIG. 1, and distribute sheets to the carrying paths B, C, and D by turning on a solenoid by rotating the path selector 15 upward and rotating the path selector 16 downward, respectively.

In the illustrative embodiment, the sheet processing device PD is capable of selectively effecting punching (punch unit 100), jogging and edge stapling (jogger fence 53 and edge stapler S1), jogging and center stapling (jogger fence 53 and center stapler S2), sorting (shift tray 202) or folding (folding plate 74 and fold rollers 81 and reinforce roller 400), as desired.

A shift tray outlet section I is located at the most downstream position of the sheet processing device PD and includes a shift outlet roller pair 6, a return roller 13, a sheet surface sensor 330, and the shift tray 202. The shift tray outlet section I additionally includes a shifting mechanism J shown in FIG. 2 and a shift tray elevating mechanism K shown in FIG. 3.

Figure 2:
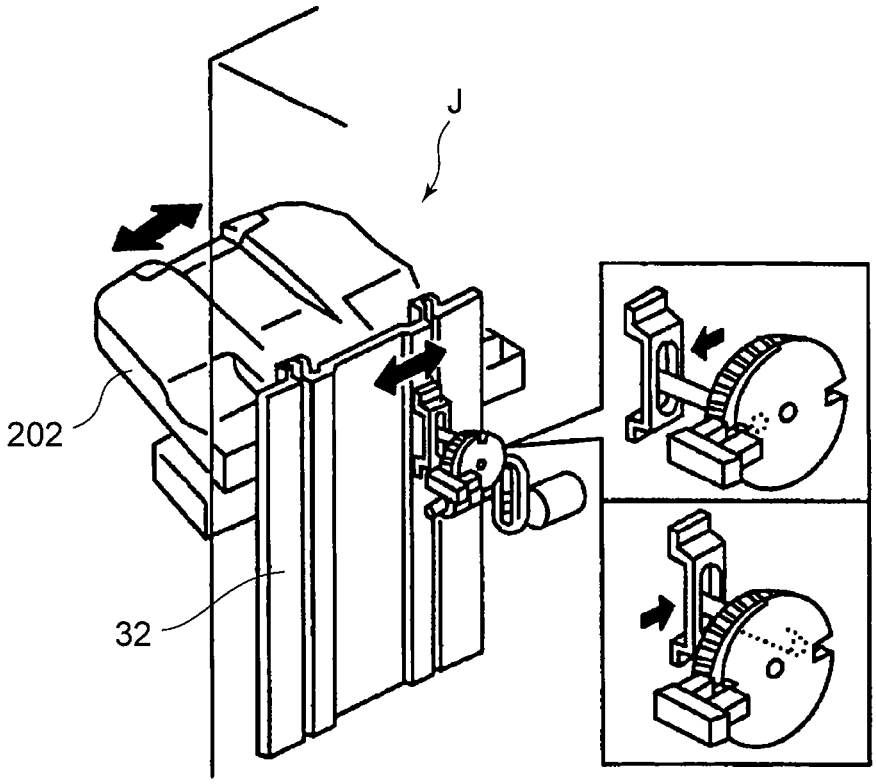
FIG. 2 is a perspective view showing a shift mechanism included in the sheet processing device.
Figure 3:
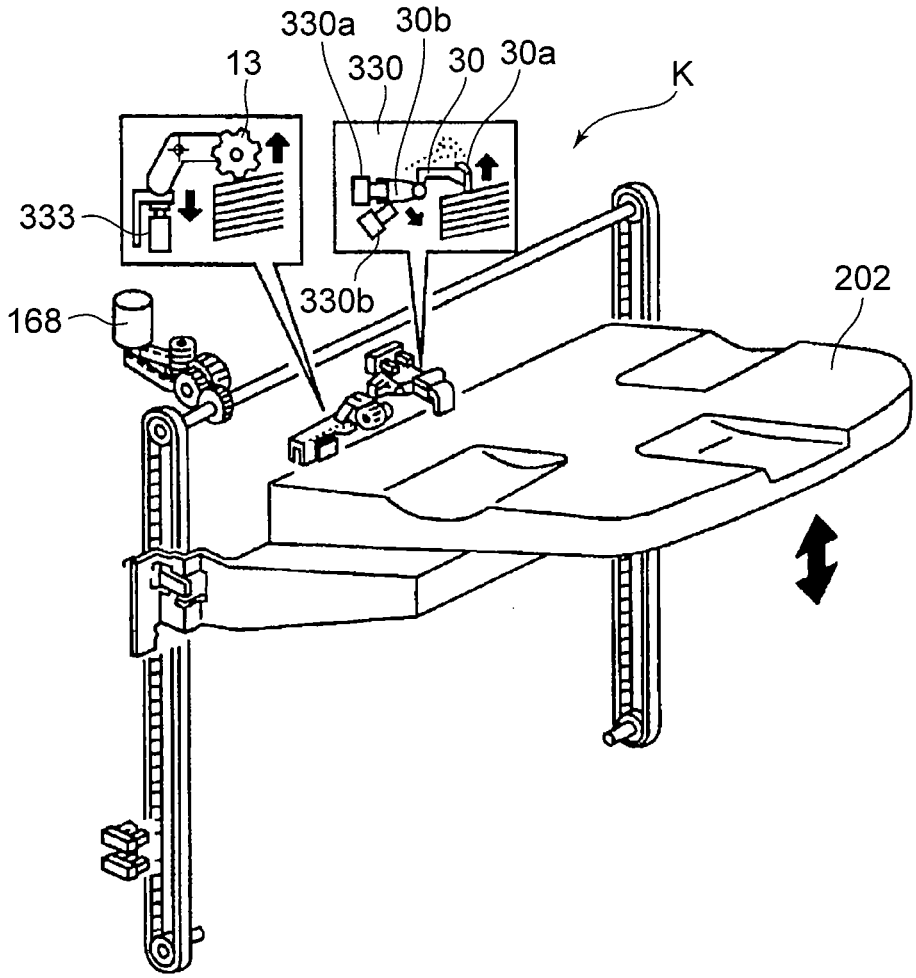
FIG. 3 is a perspective view showing a shift tray elevating mechanism included in the sheet processing device.

As shown in FIGS. 1 and 3, return roller 13 aligns sheets by sequential abutting the sheet discharged from a shift outlet roller pair 6 and abutting the trailing end of the sheet to an end fence 32 as shown in FIG. 2. A return roller 13 is formed of sponge and caused to rotate by the shift outlet roller 6. A limit switch 333 is positioned in the vicinity of the return roller 13 such that when the shift tray 202 is lifted and raises the return roller 13, the limit switch 333 turns on, causing a tray elevation motor 168 to stop rotating. This prevents the shift tray 202 from overrunning. As shown in FIG. 1, the sheet surface sensor 330 senses the surface of a sheet or that of a sheet stack driven out to the shift tray 202.

As shown in FIG. 3 specifically, the sheet surface sensor 330 is made up of a lever 30, a sensor 330*a* relating to stapling, and a sensor 330*b* relating to non-stapling 330*b*. The lever 30 is angularly movable about its shaft portion and made up of a contact end 30*a* contacting the top of the trailing edge of a sheet on the shift tray 202 and a sectorial interrupter 30*b*.

When the outputs of the sensors 330*a* and 330*b* indicate that sheets are stacked on the shift tray 202 to a pre-selected height, the tray elevation motor 168 is driven to lower the shift tray 202 by a pre-selected amount. The top of the sheet stack on the shift tray 202 is therefore maintained at a substantially constant height.

Figure 4:
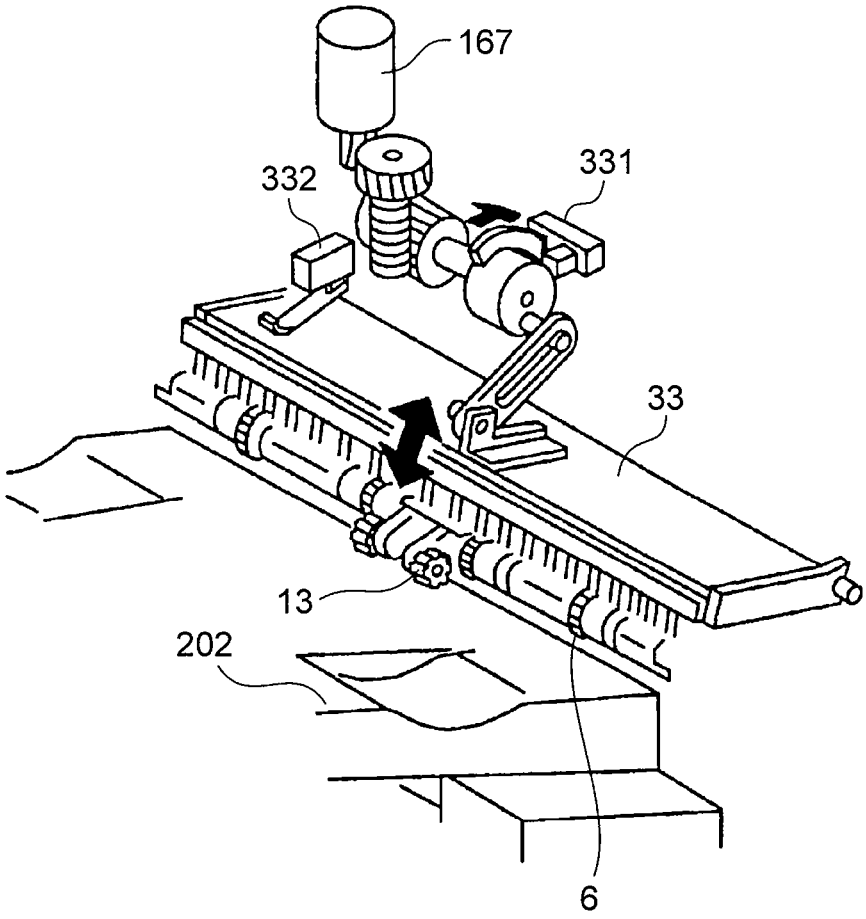
FIG. 4 is a perspective view showing an outlet section to the shift tray included in the sheet processing device.

FIG. 4 shows a specific configuration of the arrangement for discharging a sheet to the shift tray 202.

As shown in FIGS. 1 and 4, the shift roller pair 6 has a drive roller 6*a* and a driven roller 6*b*. A guide plate 33 is supported at its upstream side in the direction of sheet discharge and angularly movable in the up-and-down direction. The driven roller 6*b* is supported by the guide plate 33 and contacts the drive roller 6*a* due to its own weight or by being biased, nipping a sheet between it and the drive roller 6*a*.

When a stapled sheet stack is to be driven out to the shift tray 202, the guide plate 33 is lifted and then lowered at a pre-selected timing, which is determined on the basis of the output of the shift sensor 303. The stop position is determined in response to the detection signal of the guide plate sensor 331 and driven by a guide plate motor 167. A guide plate motor 167 drives the guide plate 33 in such a manner in accordance with the ON/OFF state of a limit switch 332.

Now, a construction of staple tray F for stapling will be described.

Figure 6:
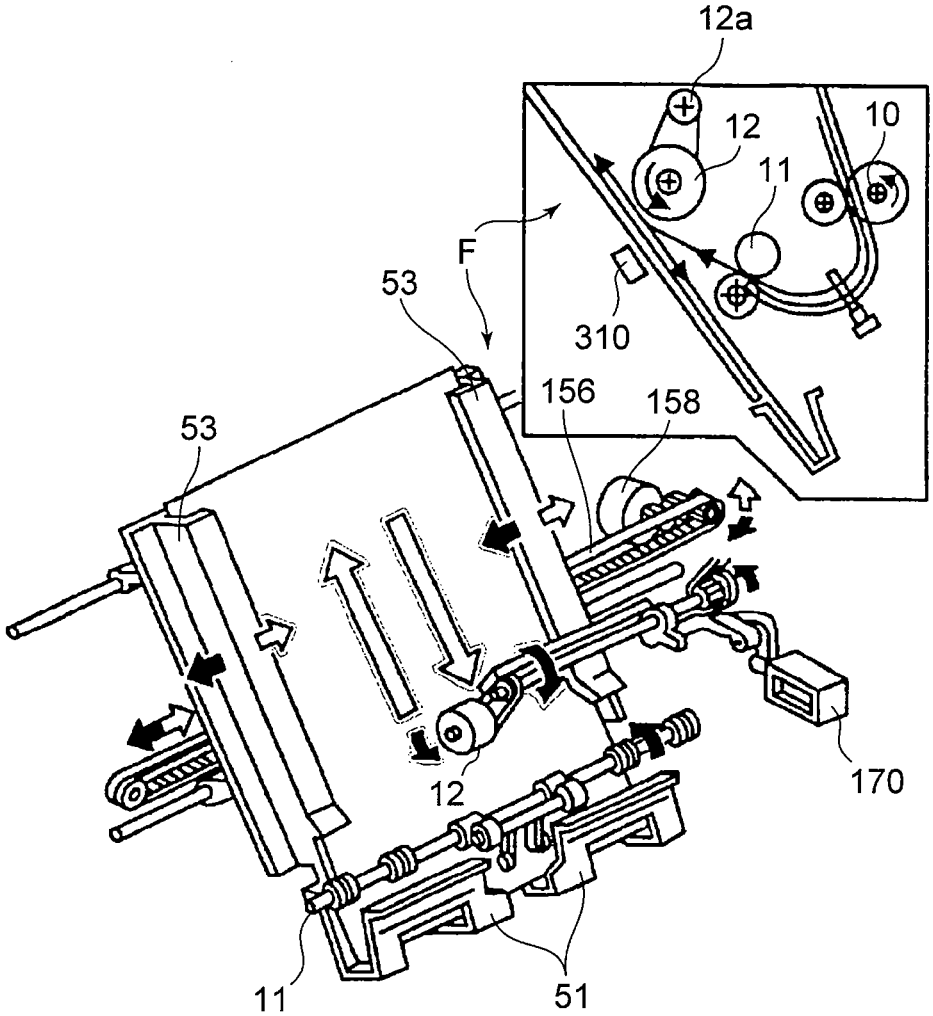
FIG. 6 is a perspective view showing the stapling tray and a mechanism for driving the stapling tray included in the sheet processing device.
Figure 7:
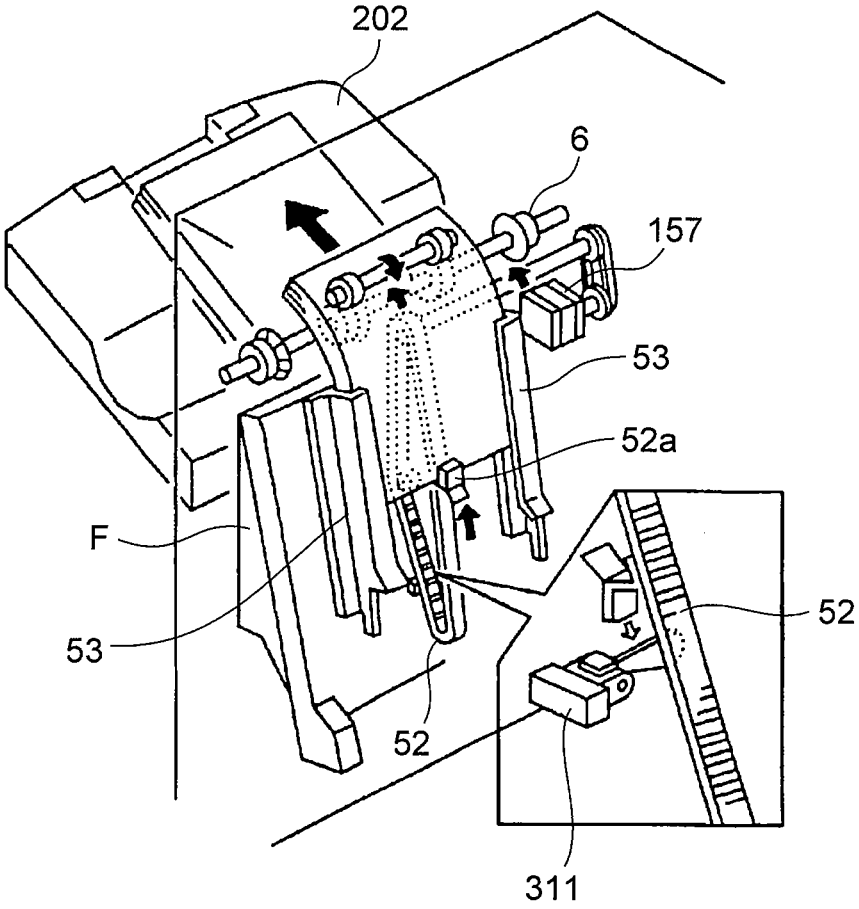
FIG. 7 is a perspective view showing a mechanism included in the sheet processing device for discharging a sheet stack.

FIG. 6 shows a drive mechanism assigned to the staple tray F while FIG. 7 shows a sheet stack discharging mechanism. As shown in FIG. 6, sheets sequentially conveyed by the staple outlet roller pair 11 to the staple tray F are sequentially stacked on the staple tray F. At this instant, a knock roller 12 knocks every sheet for positioning it in the vertical direction (direction of sheet conveyance) while jogger fences 53 position the sheet in the horizontal direction perpendicular to the sheet conveyance (sometimes referred to as a direction of sheet width). Between consecutive jobs, i.e., during an space between the last sheet of a sheet stack and the first sheet of the next sheet stack, a controller 350 (see FIG. 26) outputs a staple signal for causing an edge stapler S1 to perform a stapling operation. A discharge belt 52 with a hook 52*a* immediately conveys the stapled sheet stack to the shift outlet roller pair 6, so that the shift outlet roller pair 6 conveys the sheet stack to the shift tray 202 held at a receiving position.

As shown in FIG. 7, a belt HP (Home Position) sensor 311 senses the hook 52*a* of the discharge belt 52 brought to its home position. More specifically, as shown in FIG. 37, two hooks 52*a* and 52*a* (E are positioned on the discharge belt 52 face-to-face at spaced locations in the circumferential direction and alternately convey sheet stacks stapled on the staple tray F one after another. The discharge belt 52 may be moved in the reverse direction such that one hook 52*a* held in a stand-by position and the back of the other hook 52*a* (E position the leading edge of the sheet stack stored in the staple tray F in the direction of sheet conveyance, as needed. The hook 52*a* also plays the role of positioning means at the same time.

Figure 5:
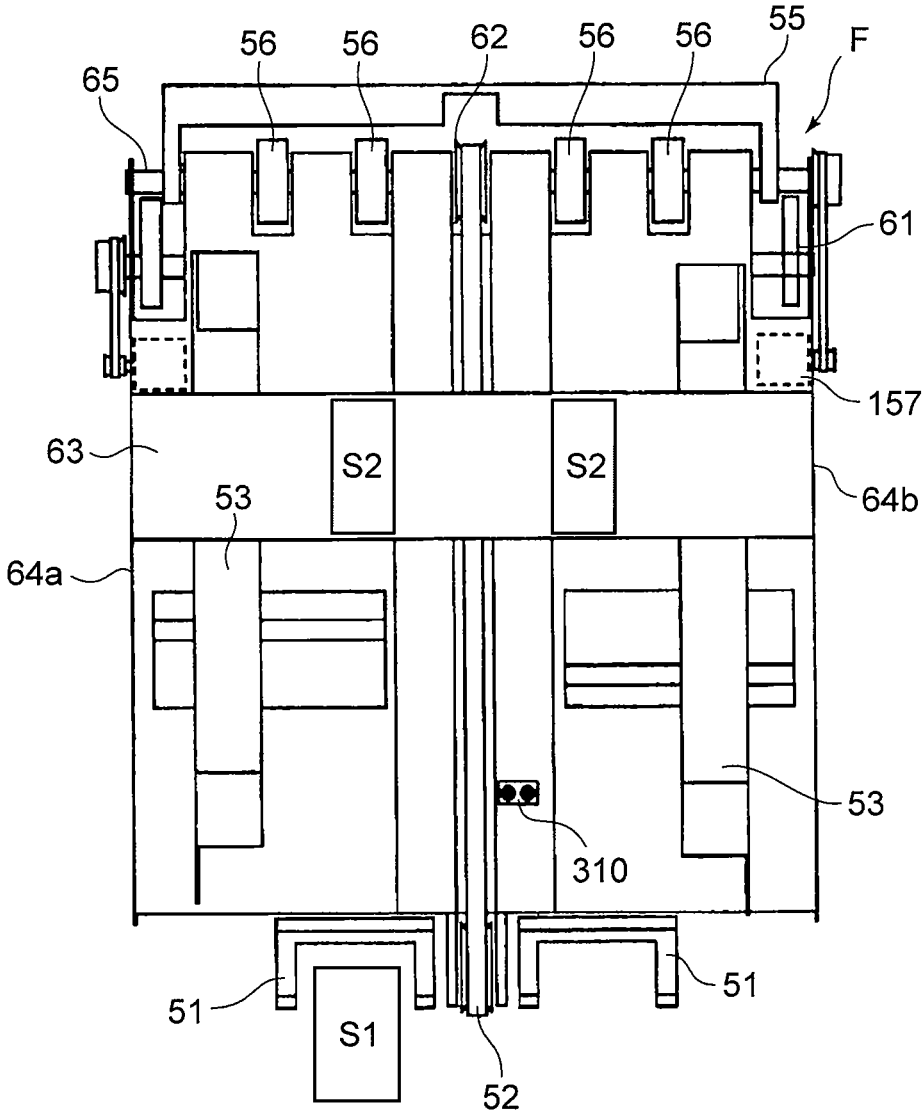
FIG. 5 is a plan view showing a stapling tray included in the sheet processing device, as seen in a direction perpendicular to a sheet conveying surface.

As shown in FIG. 5, a discharge motor 157 causes the discharge belt 52 to move via a discharge shaft 65. The discharge belt 52 and a drive pulley 62 therefor are positioned at the center of the discharge shaft 65 in the direction of sheet width. Discharge rollers 56 are mounted on the discharge shaft 65 in a symmetrical arrangement. The discharge rollers 56 rotate at a higher peripheral speed than the discharge belt 52.

A processing mechanism will be described hereinafter. As shown in FIG. 6, a solenoid 170 causes the knock roller 12 to move about a fulcrum 12*a* in a pendulum fashion, so that the knock roller 12 intermittently acts on sheets sequentially driven to the staple tray F and causes their trailing edges to abut against rear fences 51. The knock roller 12 rotates counterclockwise about its axis. A jogger motor 158 drives the jogger fences 53 via a timing belt and causes them to move back and forth in the direction of sheet width. Reciprocal rotation of the jogger motor 158 is controlled by a CPU 1501 of the control unit 1500.

Figure 8:
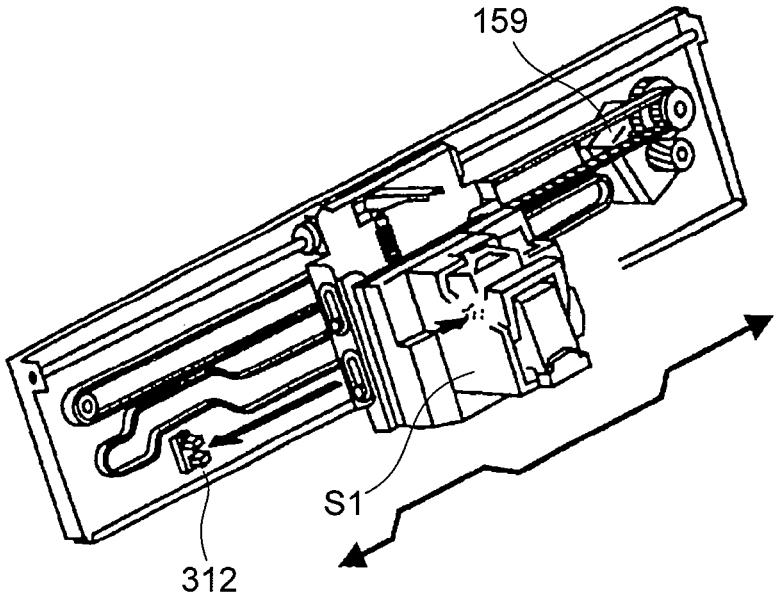
FIG. 8 is a perspective view showing an edge stapler and a mechanism for moving the edge stapler included in the sheet processing device.
Figure 9:
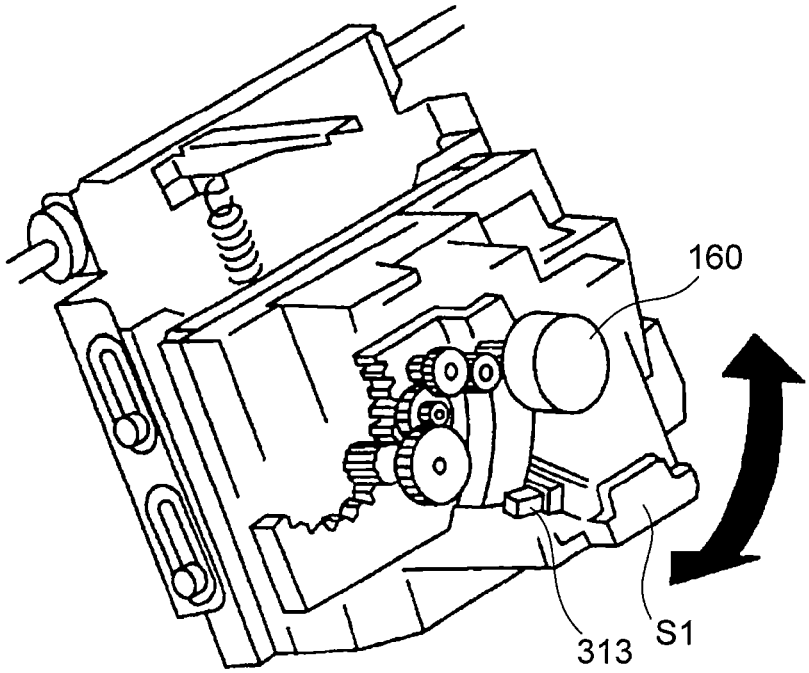
FIG. 9 is a perspective view showing a mechanism for rotating oblique the edge stapler included in the sheet processing device.

As shown in FIG. 8, a mechanism for moving the edge stapler S1 includes a reversible, stapler motor 159 for driving the edge stapler S via a timing belt. The edge stapler S is movable in the direction of sheet width in order to staple a sheet stack at a desired edge position. A stapler HP sensor 312 is positioned at one end of the movable range of the edge stapler S1 in order to sense the stapler S brought to its home position. The stapling position in the direction of sheet width is controlled in terms of the displacement of the edge stapler S1 from the home position. As shown in FIG. 9, the edge stapler S1 is capable of selectively driving a staple into a sheet stack in parallel to or obliquely relative to the edge of the sheet stack. Further, at the home position, only the stapling mechanism portion of the edge stapler S1 is rotatable by a pre-selected angle for the replacement of staples. For this purpose, an oblique motor 160 causes the above mechanism of the edge stapler S1 to rotate until a sensor 313 senses the mechanism reached a pre-selected replacement position. After oblique stapling or the replacement of staples, the oblique motor 160 causes the stapling mechanism portion to return to its original angular position.

A discharge belt 52 with a hook 52*a* immediately conveys the stapled sheet stack to the shift outlet roller pair 6. The power of the jogger motor 158 capable of bi-directional rotation is transmitted via the timing belt 156. Thereby, reciprocation moving of the jogger fence 53 is carried out to a sheet crosswise direction, and positioning of a crosswise direction (direction intersecting perpendicularly with a sheet conveying direction, and is sometimes referred to as a direction of sheet width) is performed by the jogger fence 53. The jogger fence 53 performs horizontal positioning of sheet for one time or a multiple-times, while the hook 52*a* is conveying the sheet.

The displacement of a jogger fence is determined by sheet size. Horizontal positioning is performed by one time or repeating two or more times in the operation which the jogger fence 53 moves to a position non-contacting with the sheet, and a position contacting with the sheet which is deformed with sheet sizes.

The number of times of the positioning of the crosswise direction by this jogger fence 53 is changed by size, stapling number of sheets, etc. of a sheet. When sheet size is large, the number of times of horizontal positioning is increased. Since a part of sheet stack shifts easily similarly when there are many sheets to be stapled, horizontal positioning is increased. Thus, according to the control set up beforehand, the jogger fence 53 operates and horizontal positioning is performed.

Further, the horizontal positioning is changed in accordance with one-place stapling or two-place stapling. In the case of one-place stapling, since a displacement becomes large easily during conveyance, horizontal positioning is increased.

Horizontal positioning can also be set up at the control panel in the image forming device PR. An operator can perform a setting excluding the horizontal positioning during sheet discharge. While it is also possible to arbitrarily change the number of times of horizontal positioning.

Thus, the stapled sheet stack is discharged to the shift tray 202 held at a receiving position, by being carried out in horizontal positioning during movement.

Figure 17:
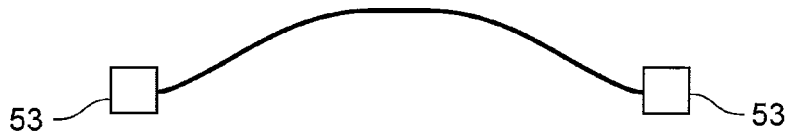
FIG. 17 is a diagram showing a position of a jogger fence and a shape of a sheet stack according to a second embodiment.

Now, a second embodiment of the sheet processing device will be described. The sheet which the stapling completed at the time of discharge of a sheet is sent to the shift outlet roller pair 6 with the discharge belt 52 provided with the hook 52*a* like the first embodiment. Under the present circumstances, the power of the jogger motor 158 in which bi-directional rotation is possible is transmitted via the timing belt 156, and it is set so that the space of the jogger fence 53 may become a position a little narrower than the width of a sheet. Thereby, some corrugation is given to the sheet stack conveyed as shown in FIG. 17. Thus, positioning of the crosswise direction of a sheet stack does not produce a displacement by giving flexure purposely to a sheet.

Here, the position of the jogger fence 53 is determined by the size of a sheet stack. The position of the jogger fence 53 may be changed according to the kind of sheet. For example, in the case of a limp sheet, compared with the regular sheet of the same size, the space of the jogger fence 53 is narrowed like a thin sheet. By such operation, a sheet stack is conveyed without shifting to a crosswise direction, then compatibility is improved.

Figure 18:
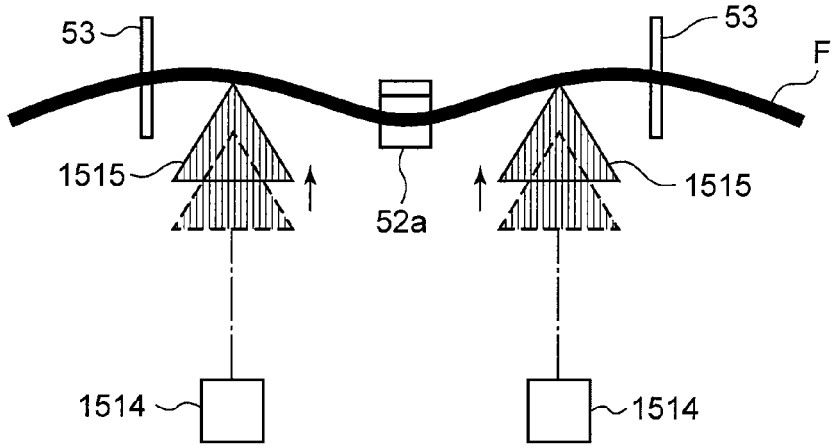
FIG. 18 is a diagram showing a shape of a stapling tray according to a third embodiment.

Now, a third embodiment will be described. The sheet which the stapling completed at the time of discharge of a sheet is sent to the shift outlet roller pair 6 with the discharge belt 52 provided with the hook 52*a* like the first embodiment. The stapling tray F is formed by raw material in which sliding aspect of surface is good and has elasticity. At the time of discharge, abutment members 1515 are pushed out to the side opposite to the sheet carrying surface of the stapling tray F by solenoids 1514 which move the abutment members 1515. Then, according to the abutment member pressing against the stapling tray 4, the shape of this stapling tray F is deformed, as shown in FIG. 18. The sheet stack is conveyed on the deformed stapling tray F by the hook 52*a*. Under the present circumstances, the power of the jogger motor 158 in which bi-directional rotation is possible is transmitted via the timing belt 56, and it is set so that the space of the jogger fence 53 may become a position a little narrower than the width of a sheet. Thereby, some corrugation is given to the sheet stack conveyed. Thus, positioning of the crosswise direction of a sheet stack does not produce a displacement by conveying by giving flexure purposely to a sheet.

Now, a case where sheets is stapled at the center is explained as a fourth embodiment. As shown in FIGS. 1 and 5, a pair of center staplers S2 are affixed to a stay 63 and are located at a position where the distance between the rear fences 51 and their stapling positions is equal to or greater than one-half of the length of the maximum sheet size, as measured in the direction of conveyance, that can be stapled. The center staplers S2 are symmetrical to each other with respect to the center in the direction of sheet width. Briefly, after a sheet stack has been fully positioned by the jogger fences 53, rear fences 51 and knock roller 5, the discharge belt 52 lifts the trailing edge of the sheet stack with its hook 52*a* to a position where the center of the sheet stack in the direction of sheet conveyance coincides with the stapling positions of the center staplers S2. The center staplers S2 are then driven to staple the sheet stack. The filed sheet stack is conveyed to the inside chip box processing suspended tray G, is folded inside and carried out.

There are also shown in FIG. 5 a front side wall 64*a*, a rear side wall 64*b*, and a sensor responsive to the presence/absence of a sheet stack on the staple tray F.

Figure 10:
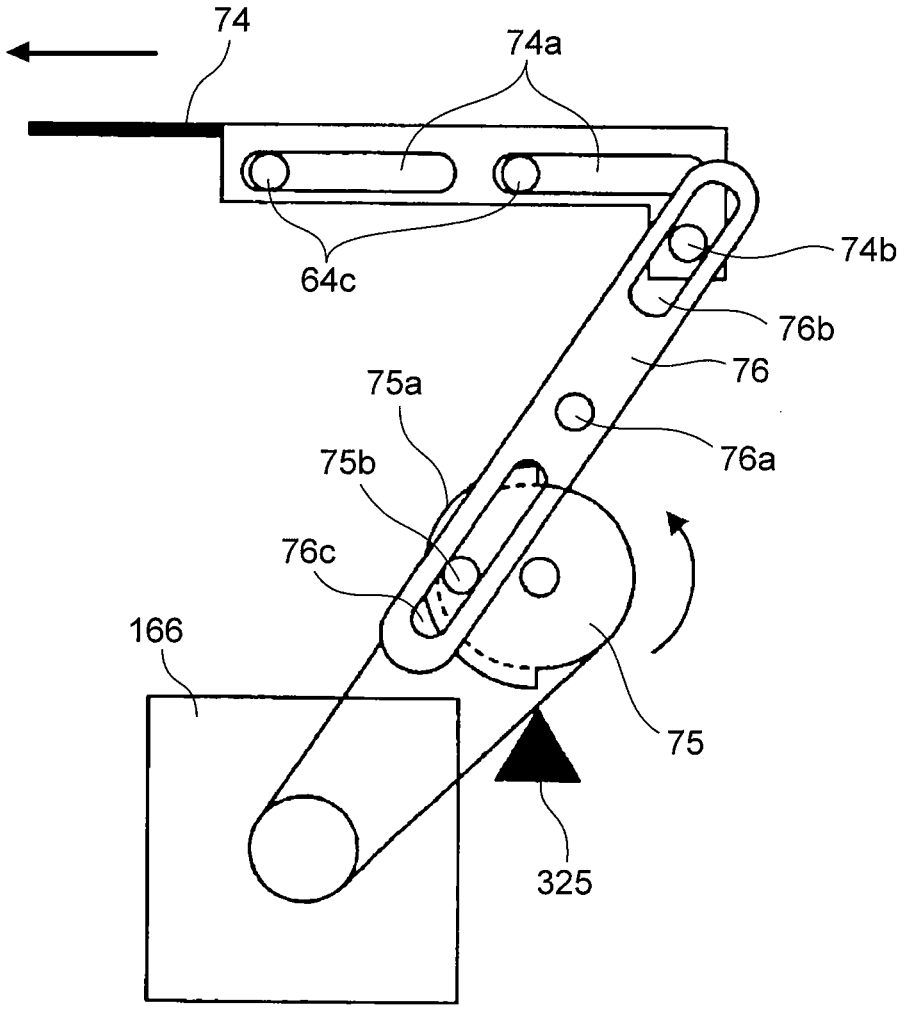
FIG. 10 is a diagram showing an operation of a mechanism for moving a folding plate included in the sheet processing device, in particular a state of the moving mechanism before entering a folding operation.
Figure 11:
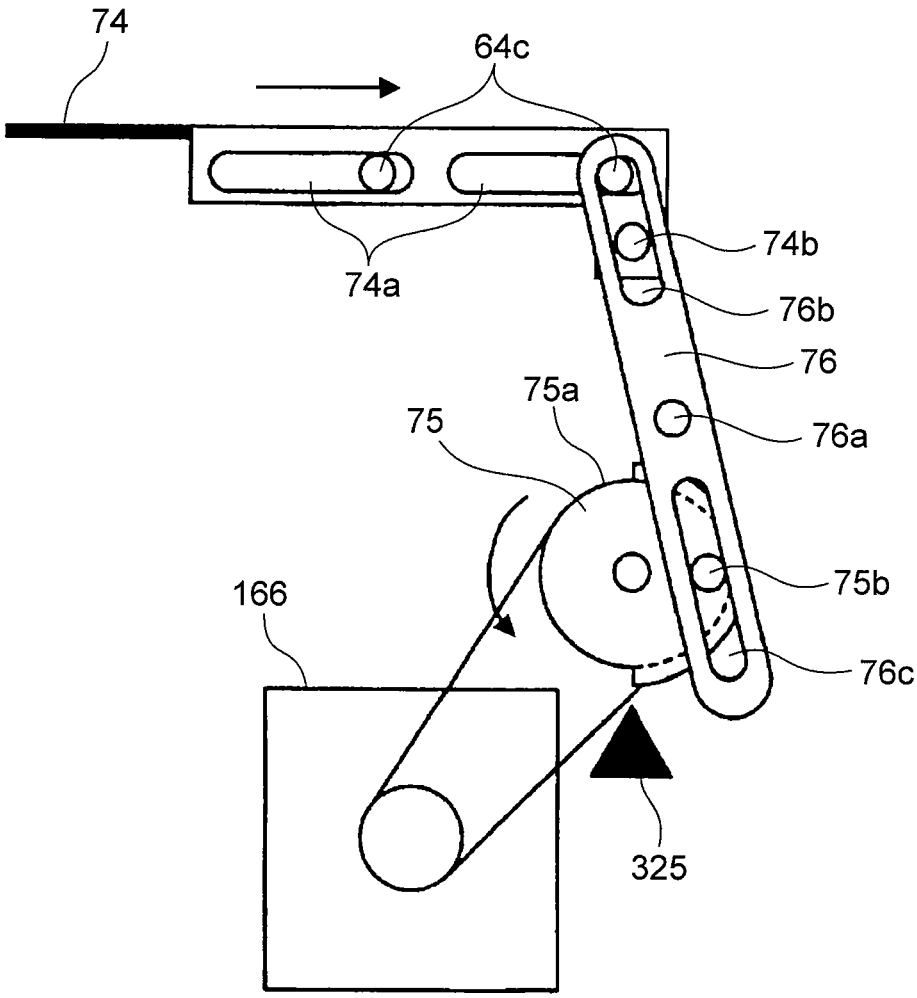
FIG. 11 is the diagram showing the operation of the mechanism for moving the folding plate included in the sheet processing device, in particular the state of the moving mechanism returning the former position after completed the folding operation.

FIG. 10 and FIG. 11 are views demonstrating the operations of the moving mechanism of the folding plate 74 for folding a sheet stack at the center.

Figure 12:
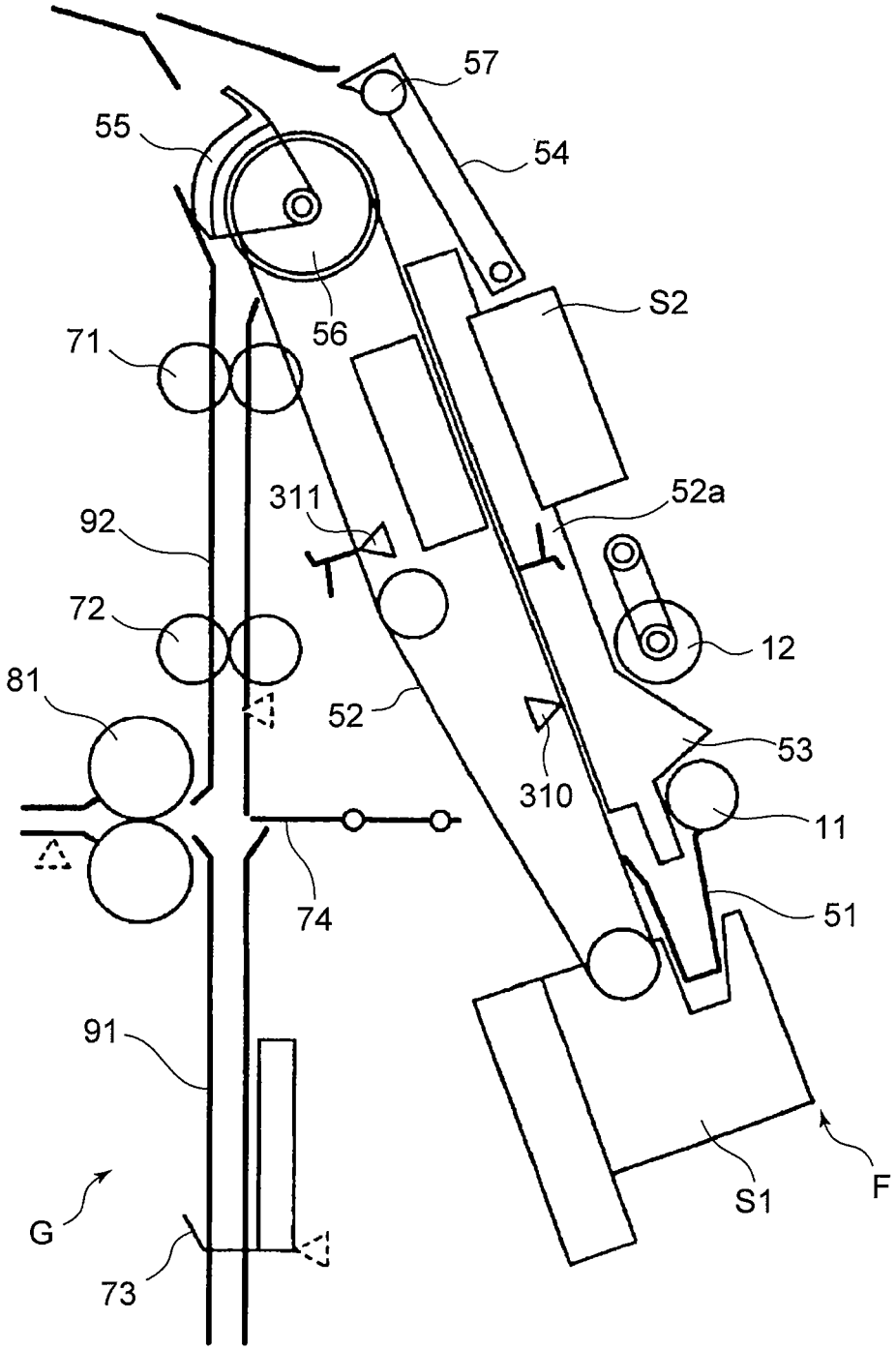
FIG. 12 is a diagram showing a view showing the stapling tray and a fold tray included in the sheet processing device.

The folding plate 74 is formed with elongate slots 74*a* each being movably received in one of pins 64*c* studded on each of the front and rear side walls 64*a* and 64*b*. A pin 74*b* studded on the folding plate 74 is movably received in an elongate slot 76*b* formed in a link arm 76. The link arm 76 is angularly movable about a fulcrum 76*a*, causing the folding plate 74 to move in the right-and-left direction as viewed in FIGS. 10 and 11. More specifically, a pin 75*b* studded on a folding plate cam 75 is movably received in an elongate slot 76*c* formed in the link arm 76. In this condition, the link arm 76 angularly moves in accordance with the rotation of the folding plate cam 75, causing the folding plate 74 to move back and forth perpendicularly to a lower guide plate 91 and an upper guide plate 92, as shown in FIG. 12.

A folding plate motor 166 causes the folding plate cam 75 to rotate in a direction indicated by an arrow in FIG. 10. The stop position of the folding plate cam 75 is determined on the basis of the output of a folding plate HP sensor 325 responsive to the opposite ends of a semicircular interrupter portion 75*a* included in the cam 75.

FIG. 10 shows the folding plate 74 in the home position where the folding plate 74 is fully retracted from the sheet stack storing range of the fold tray G. When the folding plate cam 75 is rotated in the direction indicated by the arrow, the folding plate 74 is moved in the direction indicated by an arrow and enters the sheet stack storing range of the fold tray G. FIG. 11 shows a position where the folding plate 74 pushes the center of a sheet stack on the fold tray G into the nip between a pair of fold rollers 81. When the folding plate cam 75 is rotated in a direction indicated by an arrow in FIG. 14, the folding plate 74 moves in a direction indicated by an arrow out of the sheet stack storing range.

Now, Next, a reinforce roller unit will be explained. As shown in FIG. 1, the reinforce roller unit 400 is positioned on the path H between the fold roller 81 and the outlet roller pair 83. The reinforce roller unit 400 is configured to reinforce the fold of a sheet stack folded by the folding plate 74. The reinforce roller unit 400 is configured to strengthen the fold with the reinforce roller unit 400, after stuffing into the nip of the folding roller 83 and making a crease.

Figure 13:
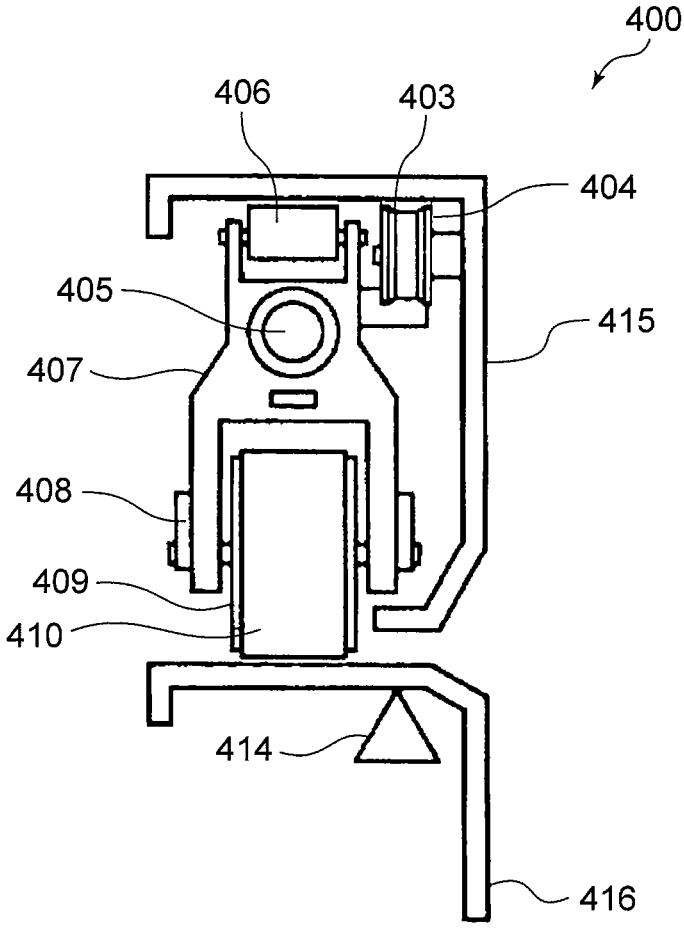
FIG. 13 is a front view showing a reinforce roller unit included in the sheet processing device.
Figure 14:
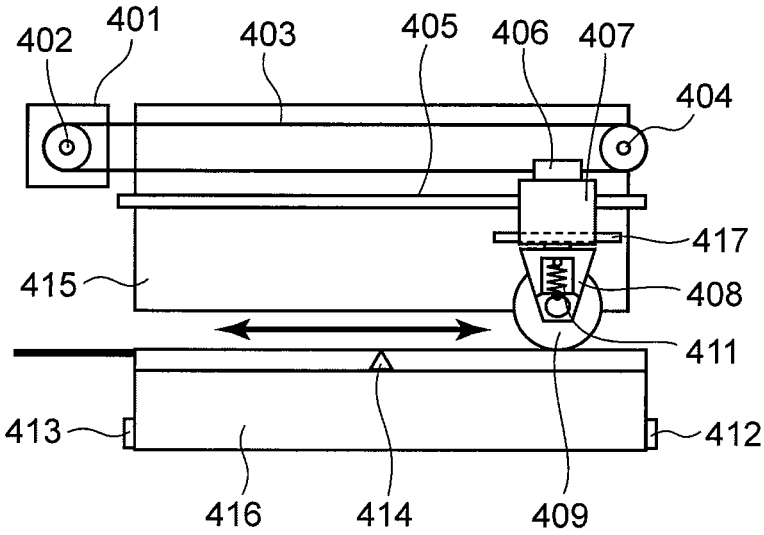
FIG. 14 is a side elevational view of the reinforce roller unit included in the sheet processing device.

As shown in the front elevational view of FIG. 13 and the side elevational view of FIG. 14, the reinforce roller unit 400 is generally made up of a reinforce roller 409, a support mechanism supporting the reinforce roller 409, and a drive mechanism for driving the reinforce roller 409. The drive mechanism includes a drive pulley 402, a driven pulley 404, a timing belt 403 passed over the pulleys 402 and 404, and a pulse motor 401 for causing the timing belt 403 to turn, as shown in FIG. 14.

The support mechanism of the reinforce roller 409 includes a slider or support member 407 slidable on a guide member 405 in a pre-selected direction, an upper guide plate 415, and a coil spring or biasing means 411. The upper guide plate 415 extends to a position above the slider 407 and remote from the reinforce roller 409 and prevents the reinforce roller 409 from tilting while preventing the guide member 405 from bending. The coil spring 411 constantly biases the reinforce roller 407 toward the folding direction, i.e., downward as viewed in FIG. 14. The drive mechanism causes the reinforce roller 409 to move in the direction in which the support mechanism extends.

Rotation of the pulse motor 401 gets across to the support member 407 combined with the timing belt 403 with the timing belt 403 stretched between the driving pulley 402 and the driven pulley 404. The move supporter 407 moves in sliding in the thrust direction of the guide member 405 by being guided by the guide member 405. A bend-preventing member 406 is positioned between the slider 407 and the upper guide plate 415 and implemented as a roller rotatably supported by the slider 407. The bend-preventing member 406 is therefore movable integrally with the slider 407 in the axial direction of the guide member 405. The reinforce roller 409 is positioned between the slider 407 and a lower guide plate 416. A friction member 410 is fitted on the circumference of the reinforce roller 409. The reinforce roller 409 reciprocate.

The reinforce roller 409 is supported by a roller support member 408, which is supported in such a manner as to be movable in the up-and-down direction in sliding contact with the slider 407. The roller support member 408 is pressurized toward the lower guide plate 416 by the coil spring 411 from the slider 407. In this configuration, the reinforce roller 409, when sliding on the guide member 405 together with the slider 407, is constantly pressed toward the lower guide plate 416 by the coil spring 411 while being movable in the up-and-down direction. Position sensors 412 and 413 are positioned at opposite sides in the direction of thrust of the guide member 405. When a detection subjective plate 417 contained in the slider 407 locates on positions of the front position sensor 412 and the rear position sensor 413, the front and rear position sensors 412, 413 detect the slider 407. The sheet stack sensor 414 detects the sheet stack conveyed to the reinforce roller unit 400.

The rear position sensor 413 detects the home position of the reinforce roller 409. More specifically, the reinforce roller 409 is moved from the position of the rear position sensor 413 toward the position of the position sensor 412 after a sheet stack has been stopped at the pre-selected position. At this instant, if the position sensor 412 does not sense the reinforce roller 409 even after a pre-selected number of pulses input to the pulse motor 402 have been counted, then it is determined that an error, i.e., the locking of the mechanism, the stop of the reinforce roller 409 ascribable to a short drive torque or the step-out of the motor 402 has occurred. A paper jam means that the apparatus falls into a state unable to convey sheet by the reinforce roller 409 abnormally stopped during the reinforcing operation by the reinforce roller 409.

When any abnormity has been detected, the pulse motor 401 is driven in the reverse direction to return the reinforce roller 409 toward the position of the rear position sensor 413. At this time, the occurrence of the sheet jam is displayed on an indicator.

Figure 15:
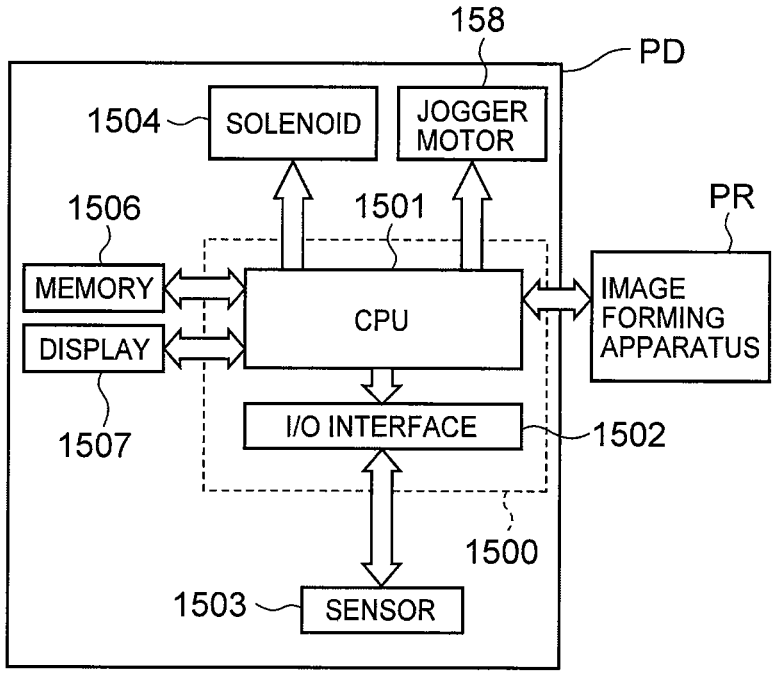
FIG. 15 is a block diagram showing a control of the sheet processing device according to the first embodiment.

FIG. 15 is a block diagram showing a control of the sheet processing device. The control unit 1500 has a CPU 1501 and an I/O interface 1502. Signals from each switches and a sensor 1503 non a control panel of the image forming apparatus PR are input into the CPU 1501 through an I/O interface 1502. The CPU 1501 controls the drive of the solenoid 1504 and the motor 1505 in response to the inputted signal.

Signals from, for example, the inlet sensor 301, the shift delivery sensor 303, the space detecting sensor 330, the delivery guide plate open-close sensor 331, the sheet presence or absence sensor 310, the discharge belt home position sensor 311, the stapler move home position sensor 312, the staple exchange position sensor 313, the folding plate HP sensor 325, the front position sensor 412, the rear position sensor 413 and the sheet stack sensor 414 are input to a CPU 1501.

CPU 1501 performs the control and the abnormity detection control of the sheet processing device PD, and the indication control for the indicator 1507 according to the program written in the memory 1506. According to the control output from the CPU 1501, a CPU provided in the image forming apparatus PR controls the indication control for the control panel.

Figure 16:
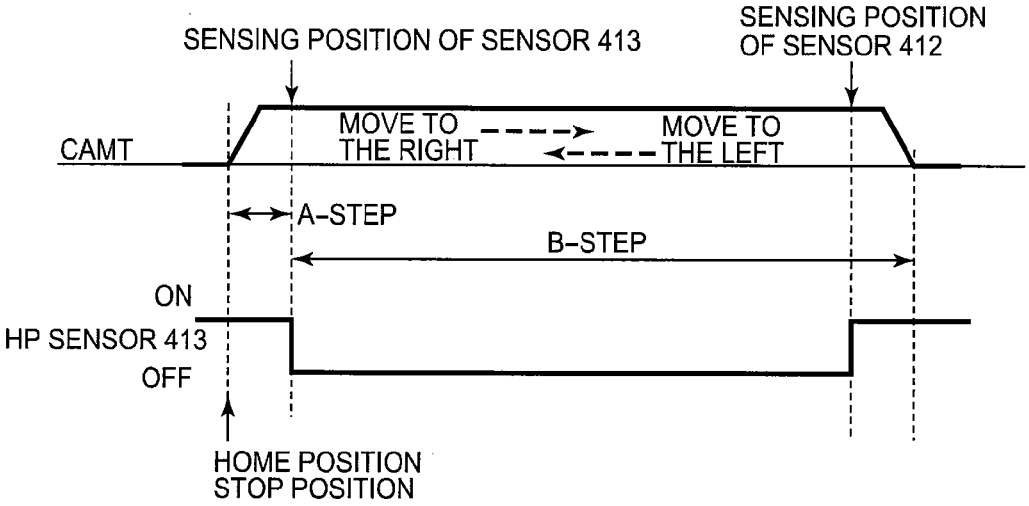
FIG. 16 is a timing chart of the movement of the folding roller for illustrating the normal reinforcing operation of the sheet.

FIG. 16 is a timing chart of the moving of the reinforce roller 409, which shows a normal folded sheet reinforcing operation. The Home position of the reinforce roller 409 is located in the outside (left side of FIG. 16) of the rear position sensor 413 at a position distant by the distance "A-STEP". At the time of folded sheet reinforcing operation, the reinforce roller 409 moves rightward by the distance "B-STEP" after detected by the rear position sensor 413. After that, the reinforce roller 409 moves back leftward. Wherein the position of the reinforce roller 409 is once again detected by the rear position sensor 413. After that the reinforce roller 409 stops by moving rightward by the distance "A-STEP". When the rear position sensor 413 has detected the detection subjective plate 417 (see FIG. 13, FIG. 14), the rear position sensor 413 turns ON. While, when the rear position sensor 413 fails to detect the detection subjective plate 417, the rear position sensor 413 turns OFF.

Hereafter, a sequence of actions from the incidence of occurring abnormity will be described. Even if the rear position sensor 413 is not set to ON within a specified time after the pulse motor 401 has been driven and the reinforce roller 409 has been moved toward the rear position sensor 413, an occurrence of sheet jam and thus occurrence of abnormity were considered. At this time, the occurrence of sheet jam is displayed on the image forming device PR. Furthermore, the occurrence of sheet jam is displayed on the indicator 1507 of the sheet processing device PD.

According to the above construction, in the occurrence of sheet jam the reinforce roller 409 can be moved to an appropriate location, as the situation demands. That is, when the home position of the reinforce roller 409 is close to the end of sheet which is to be carried out the folded sheet reinforcing operation, and where the position of the reinforce roller 409 is inadequate to release the sheet jam, the reinforce roller 409 can be moved to an adequate position for releasing he sheet jam. When the reinforce roller 409 is located closer to the end of sheet to be carried out the folded sheet reinforcing operation for giving priority to shortening a processing time, the reinforce roller 409 can be moved to an evacuation position capable of taking enough operation at the time of occurring the sheet jam. It will be helpful that the folded sheet reinforcing operation is carried out in a low speed drive with a large torque from beginning. Furthermore, it is particularly helpful that when the folded sheet reinforcing operation is finished with less slow down steps in return operation, the home position of the reinforce roller 409 is located closer to the end of sheet to be carried out the folded sheet reinforcing operation as much as possible.

The present invention can be practiced by combining the above-described first and second embodiments, not only for practicing in individual embodiment.

The above-described embodiments are presented as some examples. Therefore, they not intend to specifically limit the scope of the present invention. These embodiments can be carried out in other various forms. Therefore, the present invention can be practiced by with various change, such as an abbreviation, replacement, modification, within a range not deviating from the subject-matter of an invention. These embodiment and their modifications are included in the scope of invention together with the inventions as described in the claims as attached herewith.

What is claimed is:

1. A sheet processing device comprising:

a jogger fence configured to carry out a crosswise direction alignment of a sheet stack of sheets ejected from an image forming apparatus;

a stapling device configured to staple the aligned sheet stack;

a discharge belt configured to move the stapled sheet stack to a sheet ejection tray; and a controller configured to control movement of the jogger fence while the sheet stack is moved by the discharge belt to the sheet ejection tray to move the jogger fence more than once between a position where the jogger fence does not contact the edge of the sheet stack and a position where the jogger fence contacts the edge of the sheet stack, wherein a number of times of the crosswise direction alignment carried out by the jogger fence is different depending on whether the stapling of the stapling apparatus is one-place stapling or two-place stapling.

2. The device of claim 1 further comprising: a motor capable of bi-directional rotation connected to the jogger fence via a timing belt so as to move the jogger fence.

3. The device of claim 1, wherein an amount of movement of the jogger fence is based on a size of the sheet stack.

4. The device of claim 1, wherein a number of times of the crosswise direction alignment of the jogger fence is based on a size of the sheets in the sheet stack.

5. The device of claim 4, wherein a number of times of the crosswise direction alignment of the jogger fence is increased when a size of the sheets in the sheet stack is larger than a predetermined size compared to the number of times of the crosswise direction alignment of the jogger fence when the size of the sheets in the sheet stack is equal to or smaller than the predetermined size.

6. The device of claim 1, wherein a number of times of the crosswise direction alignment of the jogger fence is based on a number of sheets in the sheet stack to be stapled.

7. The device of claim 6, wherein a number of times of the crosswise direction alignment of the jogger fence is increased when the number of sheets of the sheet stack to be stapled is larger than a predertermined number compared to the number of times of the crosswise direction alignment of the jogger fence when the number of the sheets in the sheet stack is equal to or smaller than the predetermined number.

8. The device of claim 1, wherein the number of alignment carried out when the stapling is the one-place stapling by the stapling device is more than the number of alignment carried out when the stapling is the two-place stapling.

9. A sheet processing device comprising:

a processing tray onto which sheets are loaded to form a sheet stack;

a crosswise direction alignment plate configured to carry out crosswise direction alignment of the sheet stack;

a rear end fence acting as a lengthwise reference edge of the sheet stack;

a stapling device configured to staple the aligned sheet stack;

a discharge belt configured to move the stapled sheet stack to a sheet ejection tray; and a deforming member configured to deform the processing tray at the time of discharging the sheet stack.

10. The device of claim 9, the processing tray being formed with material having elasticity.

11. The device of claim 9, the deforming member comprising: a pair of abutment members; and a pair of solenoids configured to move the abutment members so as to push out the processing tray.

12. The device of claim 9 further comprising: a bi-directionally rotatable motor connected to the crosswise direction alignment plate via a timing belt.

* * * * *